US006295731B1

(12) United States Patent
Yamakawa et al.

(10) Patent No.: US 6,295,731 B1
(45) Date of Patent: Oct. 2, 2001

(54) METHOD OF HARDENING A VALVE FACE OF A POPPET VALVE

(75) Inventors: Kazuhiro Yamakawa, Ebina; Satoshi Fukuoka, Atsugi, both of (JP)

(73) Assignee: Fuji Oozx Inc., Kanagawa-ken (JP)

( * ) Notice: Subject to any disclaimer, the term of this patent is extended or adjusted under 35 U.S.C. 154(b) by 0 days.

(21) Appl. No.: 09/488,160

(22) Filed: Jan. 20, 2000

(30) Foreign Application Priority Data

Oct. 20, 1999 (JP) ..... 11-298049
Oct. 25, 1999 (JP) ..... 11-302285

(51) Int. Cl.[7] ..... B23P 15/00
(52) U.S. Cl. ..... 29/888.4; 123/188.4
(58) Field of Search ..... 29/888.4; 123/188.1, 123/188.2, 188.3, 188.4

(56) References Cited

U.S. PATENT DOCUMENTS 3,319,321 * 5/1967 Danis ..... 29/888.4
3,649,380 * 3/1972 Tauschek ..... 29/888.4
4,881,500 * 11/1989 Kojima et al. ..... 29/888.4

FOREIGN PATENT DOCUMENTS 2925945 7/1999 (JP) .

* cited by examiner

*Primary Examiner*—I Cuda Rosenbaum
(74) *Attorney, Agent, or Firm*—Henricks, Slavin & Holmes LLP

(57) ABSTRACT

In a valve head of a poppet valve used in an internal combustion engine, a lobe is formed. The lobe has a vertical section of an isosceles triangle which has a vertex in the middle. By pressing the lobe in a bore of a die, the lobe is plastically deformed, so that a valve face is formed at a position which contacts a valve seat. Suitable airtightness is obtained between the valve face and the valve seat.

7 Claims, 6 Drawing Sheets

METHOD OF HARDENING A VALVE FACE OF A POPPET VALVE

BACKGROUND OF THE INVENTION

The present invention relates to a method of hardening a valve face of a poppet valve to obtain high hardness and stable quality.

A valve face of an intake or exhaust valve used in an internal combustion engine is repeatedly engaged on a valve seat, keeping airtightness, and therefore requires wear resistance. Especially, in an exhaust valve of a marine diesel engine having low quality fuel, combustion residue gets into the valve face to cause pressed traces to decrease sealability. So high hardness is required.

To satisfy the requirements, Co or Ni alloy is padded and hardened on the valve face of the poppet valve to improve wear resistance. In such a hardening method by padding, padding material is different from the valve material. So the padding material is likely to peel off or cracking occurs owing to difference in thermal expansion rate. The padding material which contains rare Co increases cost in a large-sized poppet valve.

To solve such problem, there is a way for hardening a valve face. The valve face is strongly pressed by forging, or using a press or a roller and plastically deformed, so that deformation resistance or hardness against plastic sliding increases.

However, such hardening method involves the following problems. Working rate deeply concerns hardness. As working rate increases, hardness increases, but toughness decreases to let the valve face easily broken. It is necessary to determine working rate at optimum. Working rate is determined by form of the valve face before working. If the figure is not determined at optimum, there would be variation in hardness and depth, thereby causing local wear to decrease airtightness.

SUMMARY OF THE INVENTION

In view of the disadvantage, it is an object of the present invention to provide a method of hardening a valve face of a poppet valve, keeping hardness uniform on the whole valve face to prevent local wear on the valve face or valve seat to provide sufficient airtightness between the valve face and a valve seat when they are engaged to each other.

BRIEF DESCRIPTION OF THE DRAWINGS

The features and advantages of the present invention will become more apparent from the following description with respect to embodiments as shown in appended drawings wherein.

DETAILED DESCRIPTION OF PREFERRED EMBODIMENTS

Figure 1:
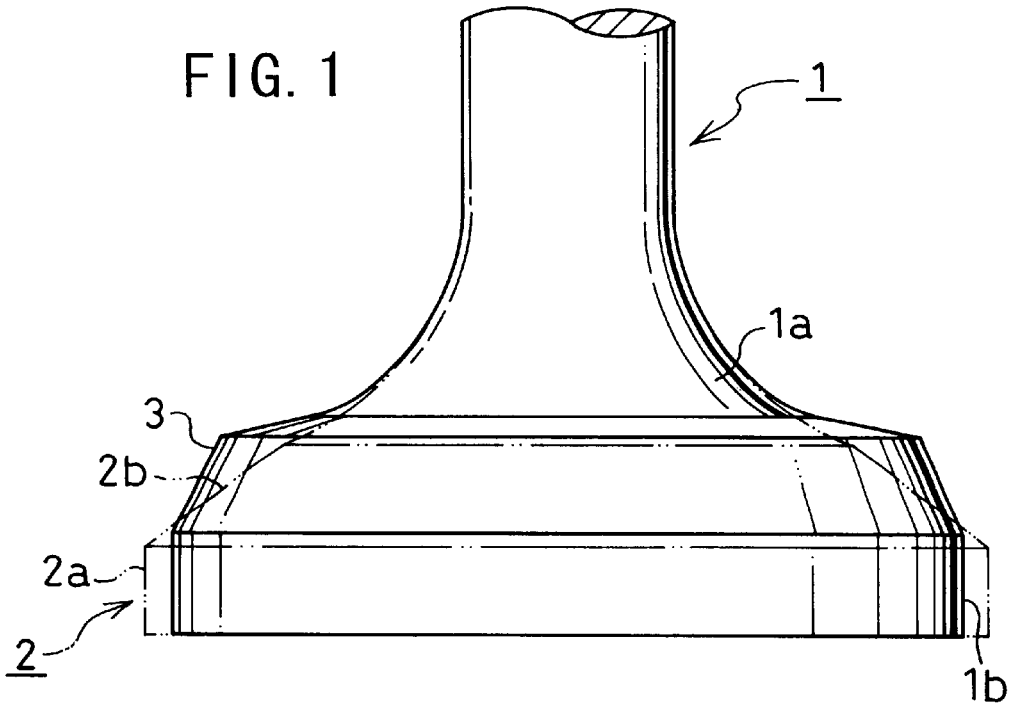
FIG. 1 is a front elevational view of a valve head of a poppet valve intermediate employed in the present invention.

FIG. 1 illustrates a valve head 1*a* of an exhaust poppet valve intermediate 1 before working. The valve intermediate 1 is made of austenitic heat-resistant steel, such as SUH 37 or Ni heat-resistant alloy such as NCF 80A and NCF 751, and solution treatment is thus made thereon.

The external diameter of a marginal portion 1*b* of the valve head 1*a* of the poppet valve intermediate 1 is slightly smaller than the external diameter of a marginal portion 2*a* of a poppet valve 2 after working as shown by a dotted line. An isosceles-triangle-sectioned lobe 3 is formed on the valve head 1*a* at a position which is corresponding to a tapered valve face 2*b* of the worked poppet valve 2.

Figure 2:
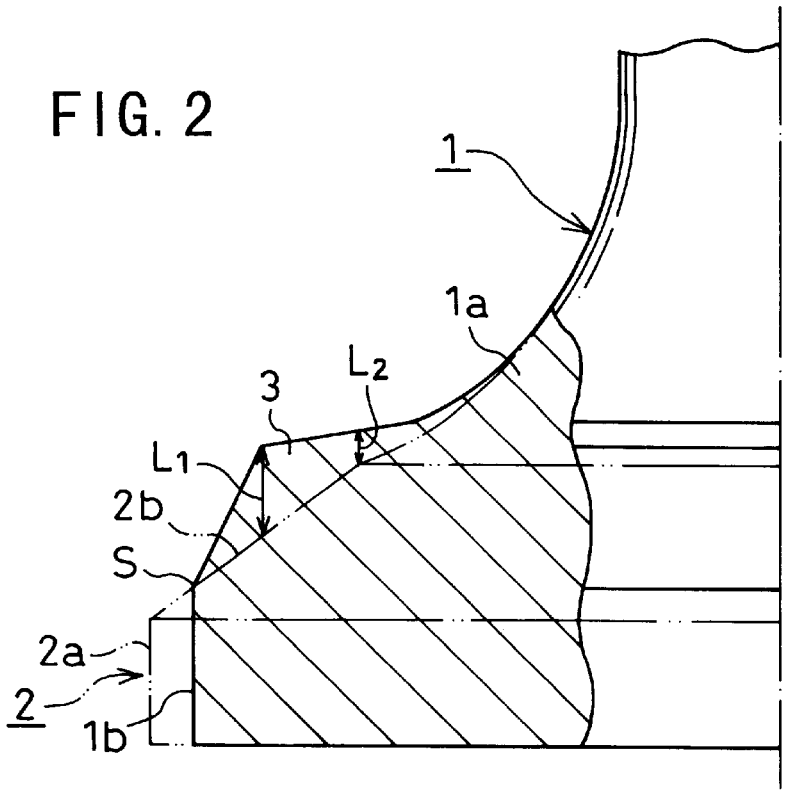
FIG. 2 is a partially cut-away front view to illustrate a lobe of the intermediate in detail.

The lobe 3 is plastically deformed into the tapered valve face 2*b*. A working rate is expressed by percentage and is difference in height between the lobe 3 and the valve face 2*b* divided by height of the lobe 3. As shown in FIG. 2, the difference is "$L_1$," in the middle of the lobe, and "$L_2$" near the inner circumferential end of the lobe 3. The working rate is the maximum in the middle and gradually decreases towards inner and outer circumferential ends of the lobe 3. There is no difference in height between the lobe 3 and valve face at the outer circumferential end "S" of the valve face 2*b* and its working rate becomes zero. In this embodiment, the working rate is 30 to 60% in the middle of the lobe 3 and is 5 to 10% at the inner circumferential end of the lobe 3.

Figure 3:
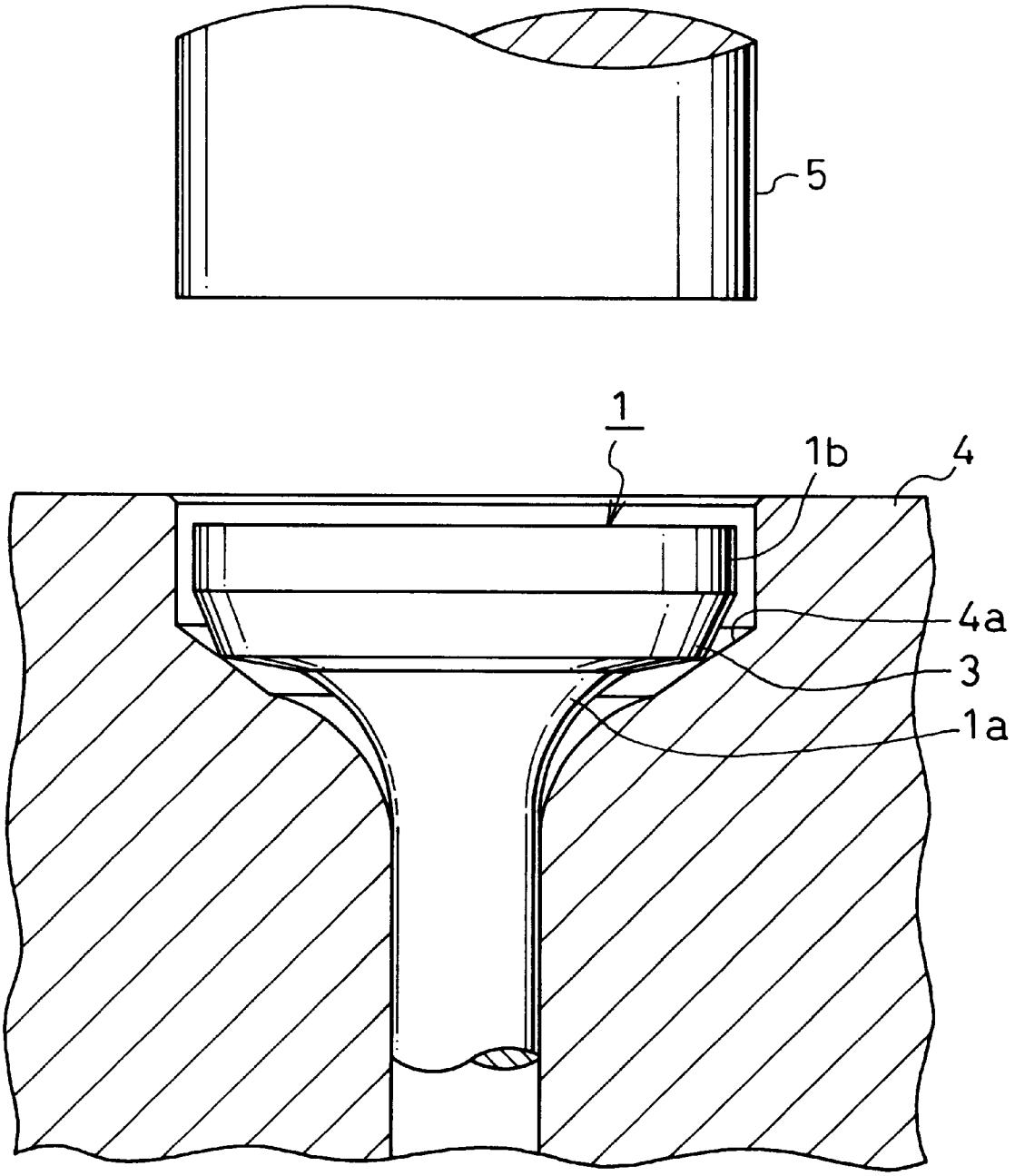
FIG. 3 is a vertical sectional front view which illustrates that the intermediate is inserted in a bore of a die to deform the lobe plastically.

The valve head 1*a* of the intermediate 1 is heated at temperature between 530 and 620° C., preferably between 550 and 600° C., and forged by a forging device as shown in FIG. 3.

Figure 7:
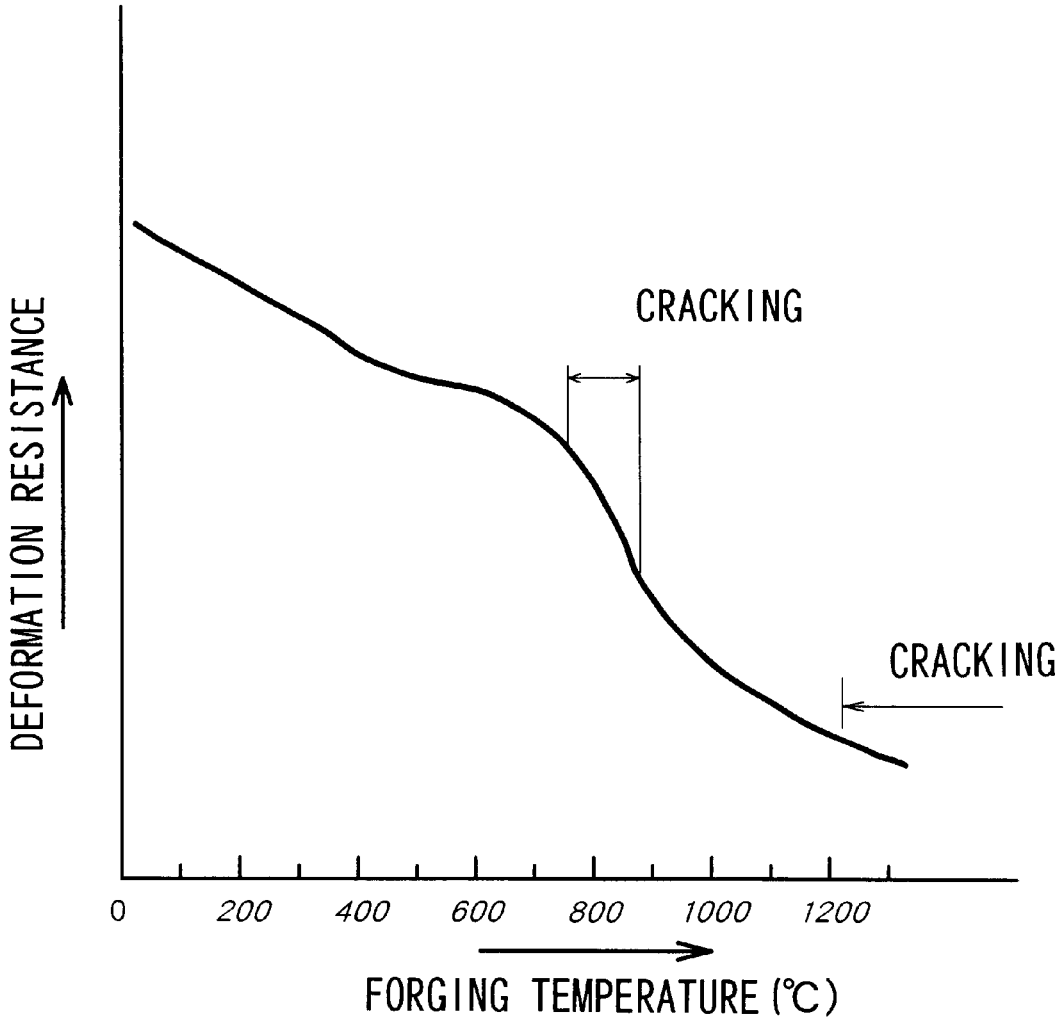
FIG. 7 is a graph which illustrates relationship between forging temperature and deformation resistance of heat-resistant Ni alloy.

The above range of heating temperature of the intermediate 1 is grounded on the following reasons. FIG. 7 is a graph which illustrates relationship between forging temperature and deformation resistance. In FIG. 7, below 530° C., deformation resistance is high. So, to harden the lobe 3 by plastic deformation, it requires a high energy, and to work a big poppet valve, it requires a large-sized forging device which provides high compression force. If heating temperature exceeds 620° C., deformation resistance decreases, and sufficient hardness by hardening cannot be obtained, so that craking occurs. In view of safety, the upper limit is set to 620° C.

Figure 5:
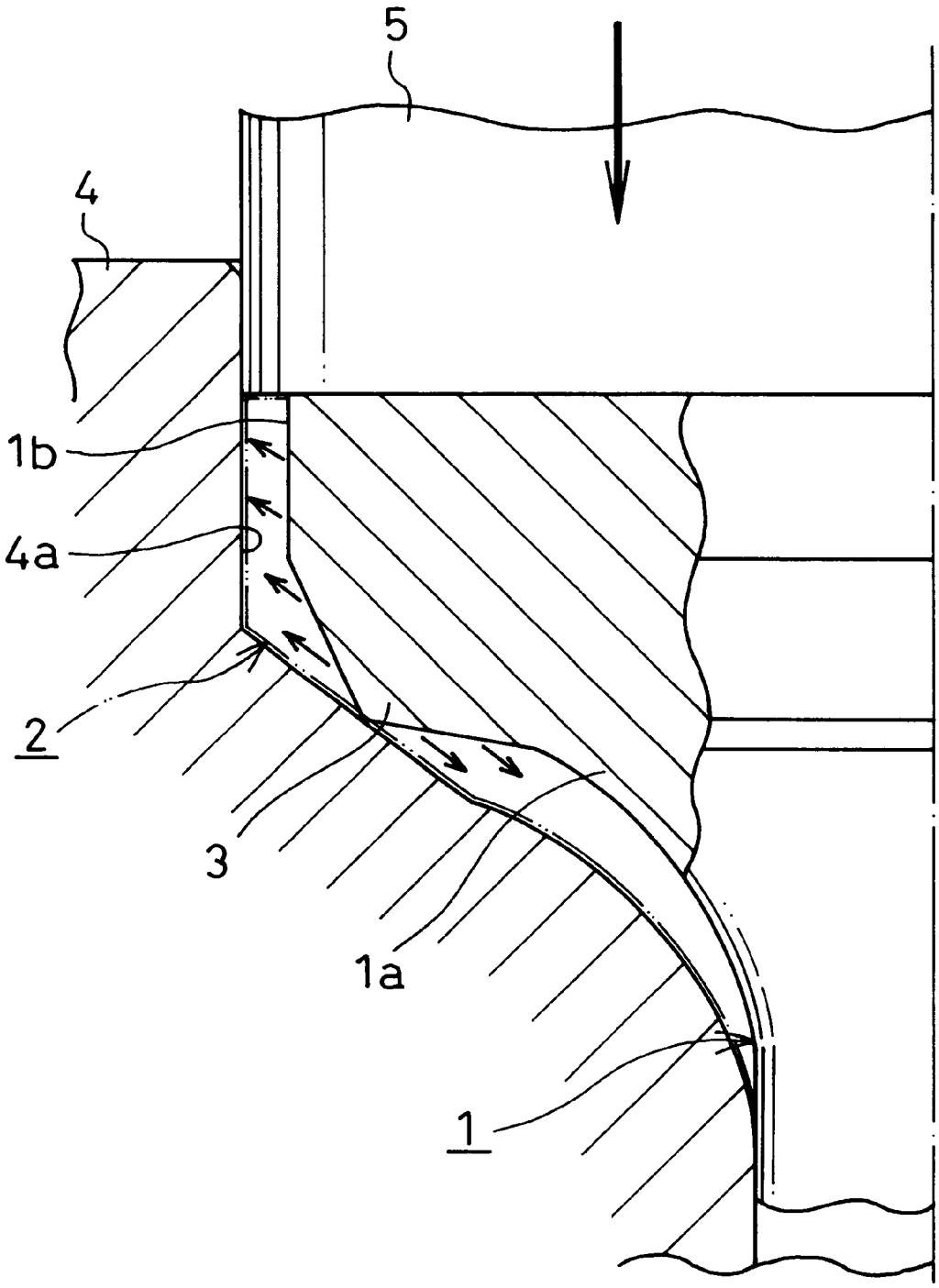
FIG. 5 is an enlarged sectional view which illustrates that the lobe is plastically deformed during forging.

As shown in FIG. 5, the intermediate 1 heated to the above temperature is vertically inserted into a bore 4*a* of a die of the forging device, putting the valve head 1*a* as top. The bore of the die 4 is matched with the valve head 1 of the poppet valve 2 in figure. A punch 5 is moved up and down by a predetermined stroke with respect to the bore 4*a*.

Figure 4:
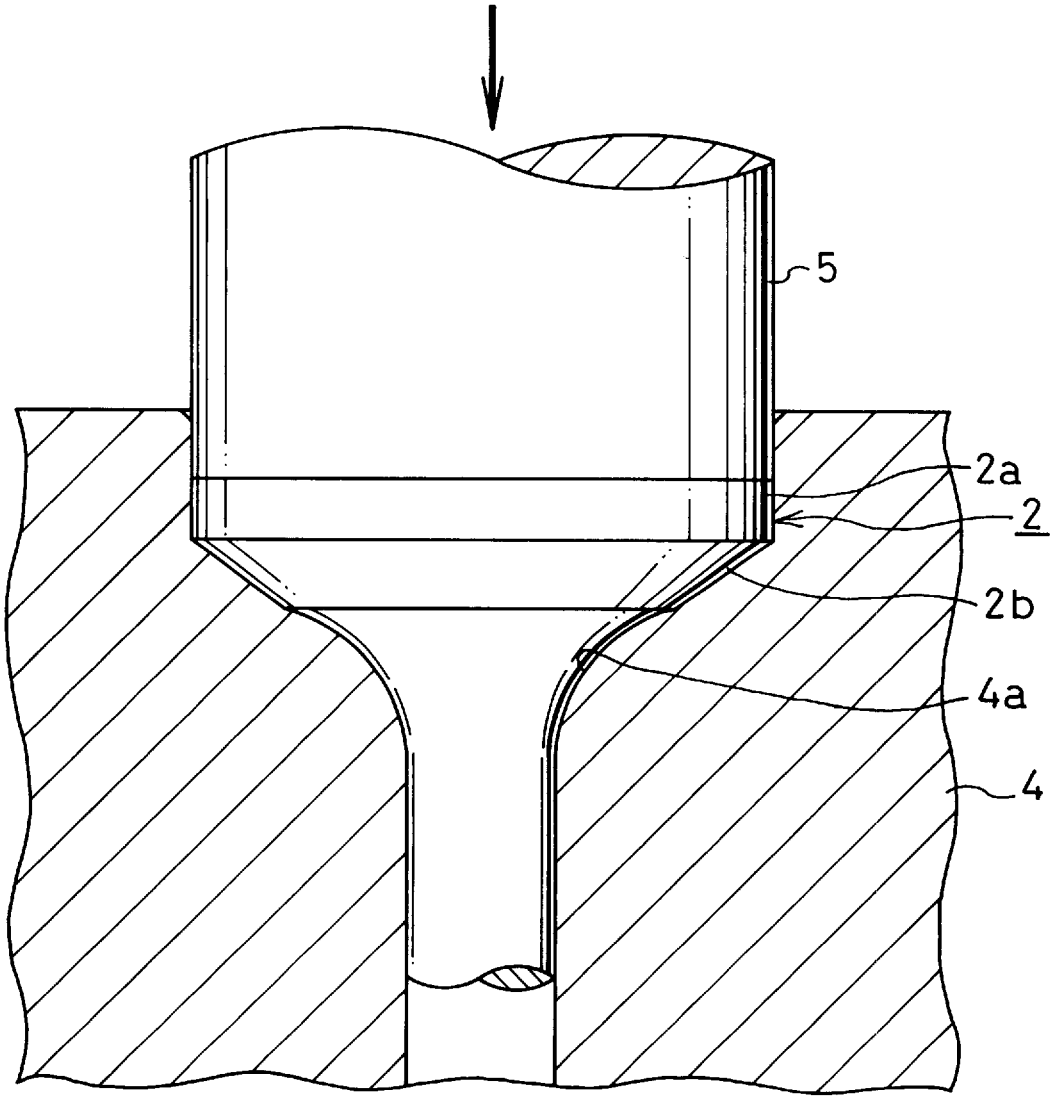
FIG. 4 is a vertical sectional front view which illustrates that the lobe is plastically deformed by lowering a punch.

The intermediate 1 is put in the bore 4*a* of the die 4, and then, as shown in FIG. 4, the punch 5 is lowered to forge the intermediate 1, so that the final poppet valve 2 is obtained. As shown in FIG. 5, during forging, the lobe 3 of the intermediate 1 is deformed in directions of inner and outer circumference as shown by arrows from the middle which has the maximum working rate and the marginal portion 1*b* of the valve head 1*a* is deformed in an outward radial direction.

Figure 6:
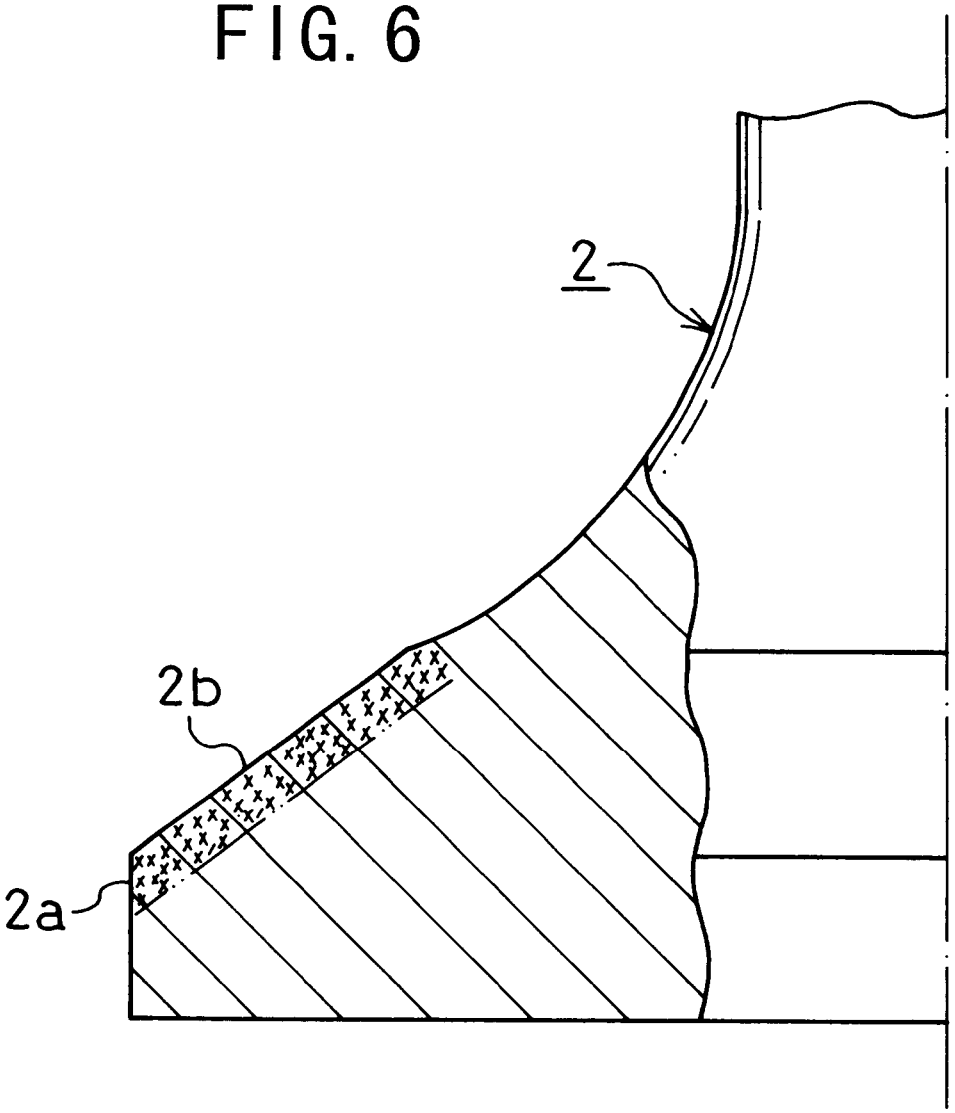
FIG. 6 is a vertical sectional view which illustrates hardness status of the valve face after working.

Thus, as shown in FIG. 6, the whole valve face 2*b* of the worked poppet valve 2 is uniformly hardened at a fixed depth, thereby obtaining high wear-resistant poppet valve 2 which does not cause local wear.

Heat resistant Ni alloy NCF80A is employed. Working rates in the middle, and at the outer and inner circumferential end of the lobe are set to about 45%, 0 and about 7% respectively at about 580° C. and forged by the foregoing procedures. After working, Vickers hardness at the surface of the valve face 2*b* of an obtained product ranges 470 to 480 Hv at any points without any significant variation. Cracking does not occur not only on the surface but also inside of the valve face 2*b*, and a high quality poppet valve 2 is thus obtained.

Age treatment such as air cooling at 700° C. for 10 hours may be further carried out to the forged poppet valve 2, thereby increasing hardness of the valve face 2*b*.

In the foregoing embodiment, to deform the lobe 3 of the intermediate plastically and harden it, the forging device is employed, but the lobe 3 is pressed from the inside to the outside and deformed plastically in a poppet valve which does not require so high pressing force.

In a large-sized poppet valve, the lobe 3 may be compressed several times vertically by a hammer of a forging device while the intermediate is rotated around a vertical axis slowly, so that it is gradually deformed every circumferential section. Thus, it avoids necessity for providing a high compressive forging device.

The foregoing merely relate to embodiments of the present invention. Various changes and modifications may be made by a person skilled in the art without departing from the scope of claims wherein:

What is claimed is:

1. A method of hardening a valve face in a poppet valve made of heat-resistant alloy, said valve having a valve head which has a valve face, which in use would seat against a valve seat, said method comprising the steps of:

forming a lobe at a predetermined position on a poppet valve intermediate at a position which would correspond to a position of the valve face on the poppet valve, the lobe having a maximum working rate at an approximate mid-point between inner and outer circumferential ends of the lobe, the working rate being expressed as a percentage of a difference in height between the lobe and the valve face divided by height of the lobe, the working rate of the lobe gradually decreasing towards the inner and outer circumferential ends; and pressing said lobe at a temperature between 530° C. to 620° C. to deform it plastically to harden it to the valve face.

2. A method as claimed in claim 1 wherein the maximum working rate in the middle of the lobe has a value between 30 to 60%, and the working rate near an inner circumferential end of the lobe is 5 to 10%.

3. A method as claimed in claim 1 wherein said step of pressing the lobe is carried out at a temperature of between 550° C. and 600° C.

4. A method as claimed in claim 1 wherein the step of forming the lobe includes the step of forming the lobe to extend from the surface of the valve intermediate in the shape of an isosceles triangle which has a vertex in the middle of the lobe.

5. A method as claimed in claim 1 wherein the step of pressing the lobe comprises inserting the poppet valve intermediate into a bore of a die which is matched with the valve head and pressing the lobe strongly to deform it plastically.

6. A method as claimed in claim 1, further comprising the step of age treatment after plastically deformation of the lobe.

7. A method as claimed in claim 1 wherein the step of pressing the lobe includes the step of pressing the lobe in both directions toward inner and outer circumferential ends.

* * * * *